United States Patent [19]

Kondo

[11] Patent Number: 4,623,272

[45] Date of Patent: Nov. 18, 1986

[54] MECHANISM FOR MOUNTING INK RIBBON CASSETTE

[75] Inventor: Hiroatsu Kondo, Zushi, Japan

[73] Assignee: Canon Kabushiki Kaisha, Tokyo, Japan

[21] Appl. No.: 561,934

[22] Filed: Dec. 15, 1983

[30] Foreign Application Priority Data

Dec. 17, 1982 [JP] Japan ..... 57-220220

[51] Int. Cl.[4] ..... B41J 32/00

[52] U.S. Cl. ..... 400/208; 400/196.1

[58] Field of Search ..... 400/194, 195, 196, 196.1, 400/207, 208, 208.1; 242/197, 198, 199, 200, 194, 55.19 A

[56] References Cited

U.S. PATENT DOCUMENTS

| | | | |
|---|---|---|---|
| 3,904,017 | 9/1975 | Frechette | 400/196.1 |
| 3,918,569 | 11/1975 | Parker | 400/196 |
| 4,130,367 | 12/1978 | Guerrini et al. | 400/196 X |
| 4,156,572 | 5/1979 | Carena | 400/196 |
| 4,264,223 | 4/1981 | Bemis et al. | 400/208 |
| 4,265,552 | 5/1981 | Bemis et al. | 400/208 X |
| 4,347,007 | 8/1982 | Schaefer | 400/208 |
| 4,359,288 | 11/1982 | Bullock | 400/208 |
| 4,405,246 | 9/1983 | Suzaki | 400/208 X |
| 4,468,143 | 8/1984 | Volke et al. | 400/196 |

FOREIGN PATENT DOCUMENTS

| | | | |
|---|---|---|---|
| 2515899 | 10/1976 | Fed. Rep. of Germany | 400/208 |
| 2929743 | 2/1981 | Fed. Rep. of Germany | 400/208 |
| 0027385 | 3/1981 | Japan | 400/208 |
| 0069189 | 6/1981 | Japan | 400/208 |

OTHER PUBLICATIONS

IBM Technical Disclosure Bulletin, "Cartridge-Release Mechanism," Jenkins, vol. 22, No. 3, Aug. 1979, pp. 876–879.

*Primary Examiner*—Ernest T. Wright, Jr.

*Attorney, Agent, or Firm*—Fitzpatrick, Cella, Harper & Scinto

[57] ABSTRACT

An ink ribbon cassette mounting mechanism is generally constructed with a guiding device for guiding an ink ribbon cassette, housing an ink ribbon and having an engaging part on the wall surface thereof, from a predetermined direction to a predetermined position. An engaging and holding device is engaged with the engaging part on the ink ribbon cassette to hold the same at the predetermined position, when the ink ribbon cassette is shifted from the predetermined direction to the predetermined position; and releases the engagement with the engaging part, when the ink ribbon cassette is further shifted in the predetermined direction.

4 Claims, 8 Drawing Figures

MECHANISM FOR MOUNTING INK RIBBON CASSETTE

BACKGROUND OF THE INVENTION

1. Field of the Invention

This invention relates to a mechanism for mounting an ink ribbon cassette, in which an ink ribbon for printing is housed.

2. Description of Prior Art

In a printing device such as a typewriter, or the like which performs printing of letters and characters by application of percussive force onto a printing sheet using type elements and an ink ribbon, there has been widely adopted a system, wherein, with a view to enabling the ink ribbon to be replaced with ease and without staining the hands of an operator of the printing device, an ink ribbon cassette (hereinafter simply referred to as a "cassette") housing therein an ink ribbon is placed on a carriage of the printing device.

FIG. 1 of the accompanying drawing illustrates schematically a construction of a printer head section of a typewriter, on which the cassette is mounted.

In the illustration, a reference numeral 1 designates a platen which functions to feed a printing sheet and to serve as a printing table. In front of the platen 1, there is horizontally arranged a supporting shaft 5 along and in parallel with the platen 1. A carriage 2 is mounted on this supporting shaft 5 in a freely slidable manner.

At the rear part of the carriage 2, an endless belt 6 to be driven and run by an electric motor 7 is fixedly secured, with which the carriage 2 is caused to move along the platen 1.

At the front part of the carriage 2, there are mounted a character wheel 4 as the printing means and a hammer 3 to strike any of the character type elements on the wheel 4 at the time of printing. A cassette 8 containing therein an ink ribbon 9 is also fitted on this carriage 2 in a manner to surround the character wheel 4 and the hammer 3.

The cassette 8 contains, in the main body 8'' of its casing unit 8', a spool (not shown) with unused ink ribbon 9 wound around it and a take-up spool (not shown) to wind the used ink ribbon 9 on it. The cassette 8 has a pair of arm portions **8*a*, 8*a* with their forward ends facing the platen 1 defining an open space. The ink ribbon 9 extended between both spools runs through these open sections of the arm portions 8*a*, 8*a*** to be exposed outside.

The cassette 8 is mounted on the carriage 2 in such a manner that the ink ribbon 9 extended and running between the forward ends of the arm portions **8*a*, 8*a* of the cassette 8 may be positioned with a gap between the character wheel 4 and a printing sheet (not shown in the drawing) on the platen 1. At the time of the printing operations, any character type element on the character wheel 4, which is hit by the printing hammer 3 at its back, applies the percussive force onto the ink ribbon 9** to thereby perform printing of the character or letter on the printing sheet.

On the other hand, the cassette 8 is usually provided with two pivot points (not shown in the drawing) to shift the ink ribbon 9 downwardly so that the operator of the printing device is able to see the printed character or letter at every printing operation. At the time of printing, the cassette 8 is pivoted up and down by a shift mechanism (not shown) with the pivot points as the center of oscillation.

Most of the conventional constructions of the mechanism for mounting the cassette 8 on the carriage 2, as mentioned above, adopt a system wherein an elastic member is provided on one part of the cassette main body 8'' so that the cassette 8 may be mounted on the carriage 2 by being pushed against the resilient force of this elastic member and may be removed from the carriage 2 by being pulled out against the resilient force.

In such construction as mentioned above, however, since the direction in which the cassette 8 can be removed from the carriage 2 is restricted when the operator tries erroneously to pull out the cassette 8 forcibly with vigor, the cassette 8 or the mounting mechanism itself may be disadvantageously damaged.

As another structure of the conventional cassette mounting mechanism, there has been mostly adopted a system wherein the above-mentioned two pivot points are used as the operating points for the mounting and dismounting of the cassette 8, the pivot points of which are held in position or released from it by means of a claw-shaped hooking member (not shown). With this construction, however, since the two pivot points must be arrested or released simultaneously at the time of the cassette mounting and dismounting, the mechanism becomes inevitably complicated and the printing device as a whole becomes disadvantageously expensive.

SUMMARY OF THE INVENTION

In view of the foregoing description, it is an object of the present invention to provide an ink ribbon cassette mounting mechanism which is simple in construction and facilitates removal of the ink ribbon cassette.

It is another object of the present invention to provide an improved ink ribbon cassette mounting mechanism with more simplified construction, in which an engaging part of the ink ribbon cassette is directly guided by a guide means.

It is still another object of the present invention to provide an improved ink ribbon cassette mounting mechanism having an engaging and holding means which is constructed with the maximum possible simplicity using an extremely small number of component parts.

It is other object of the present invention to provide an improved ink ribbon cassette mounting mechanism which can be mounted exactly at a predetermined position at the time of its mounting by being abutted against a stopper portion.

It is still other object of the present invention to provide an improved ink ribbon cassette mounting mechanism which can readily provide extremely easily a mechanism for holding the ink ribbon cassette in a rotatable manner by facilitating removal of the ink ribbon cassette directly from the pivot points for oscillation of the cassette.

It is further object of the present invention to provide an ink ribbon cassette mounting mechanism, in which the construction of a supporting device for the ink ribbon cassette is simplified to the maximum possible extent.

It is still further object of the present invention to provide an improved ink ribbon cassette mounting mechanism which makes it much easier to remove the cassette by automatically ejecting it at the time of its removal from the carriage.

The foregoing objects, other objects as well as the specific construction and function of the ink ribbon cassette mounting mechanism according to the present invention will become more apparent and understandable from the following detailed description thereof, when read in conjunction with the accompanying drawing.

BRIEF DESCRIPTION OF THE DRAWING

In the drawing:

FIGS. 3 through 7A are respectively schematic side views for explaining the mounting and dismounting operations of the ink ribbon cassette shown in FIG. 2.

DETAILED DESCRIPTION OF PREFERRED EMBODIMENT

Figure 1:
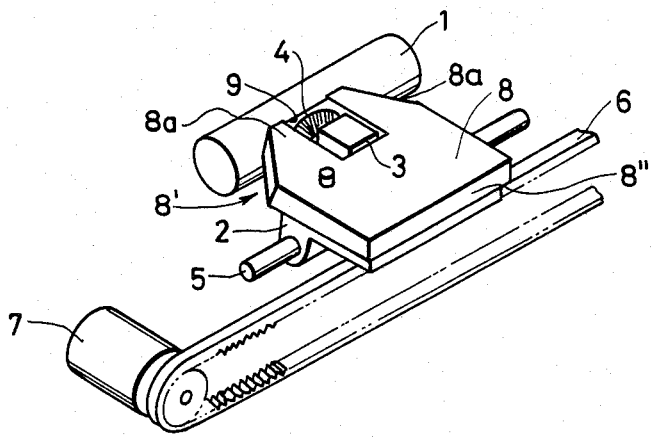
FIG. 1 PRIOR ART
FIG. 1 is a perspective view showing a construction of the main part of a printing device having a conventional ink ribbon cassette mounting mechanism.

In the following, the present invention will be described in detail with reference to a preferred embodiment thereof shown in the drawing. It should be noted that, in the drawing, the same component parts are designated by the identical reference numerals, and the explanations of such identical parts will not be repeated. It should also be noted that, in the ensuing description, a term "front" or "frontside" refers to the side of the cassette closer to the platen 1 (the left side in the drawing), and the term "back" or "backside" refers to the side of the cassette which is away from the platen (the right side in the drawing).

Structure of the Ink Ribbon Cassette

Figure 2:
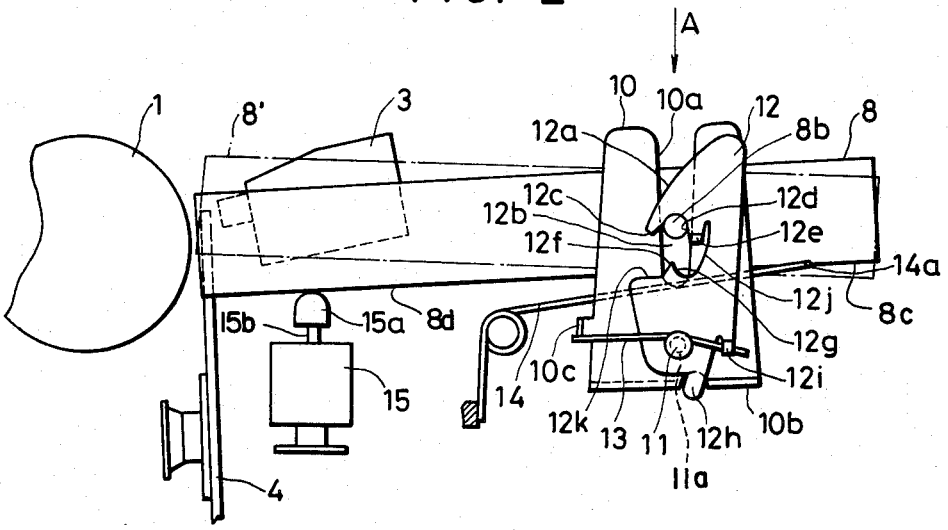
FIG. 2 is a schematic side view for explaining a construction of one embodiment of the ink ribbon cassette mounting mechanism according to the present invention.

FIG. 2 shows the mounting mechanism of the ink ribbon cassette according to the present invention and the ink ribbon cassette 8 mounted on the mechanism.

In the drawing, there are mounted, on the carriage 2 (not shown in FIG. 2) facing the platen 1, a character wheel 4 in the frontmost part thereof and a printing hammer 3 toward its backside. The ink ribbon cassette 8 contains within the casing a pair of ink ribbon spools (not shown in the drawing), from which the ink ribbon 9 is drawn outside of the casing unit 8' to pass the front face of the character wheel 4 and to enable thereby the printing operation to be effected. On both lateral surfaces at the backside of the casing unit 8' of the ink ribbon cassette 8, there are formed a pair of projections **8*b*, 8*b* which serve as the pivot points for oscillatory movement of the cassette 8. (Note that, in the drawing, only one of the two projections 8*b* at one side is shown). These projections 8*b*, 8*b* have also the function of an engaging part which is engaged with and held by an engaging and holding means of the cassette mounting mechanism to be explained later. On the carriage 2, there are fixedly provided a pair of supporting plates 10, 10 for guiding the projections 8*b*, 8*b* in the direction of an arrow A as shown in the drawing up to their support positions, while being in contact with the projections 8*b*, 8*b***.

Each of the supporting plates 10, in a substantially rectangular shape, is provided in an upright attitude on each side of the carriage 2 at its rear part and at a position corresponding to the above-mentioned projection **8*b* (in the drawing, only one of the plates 10 is shown). Each supporting plate 10 is provided in the direction substantially perpendicular to the axis of the platen 1 as well as to the plane of the top surface of the carriage 2. The supporting plate 10 further has a deep U-shaped groove 10*a* formed therein, with and by which the projection 8*b* is engaged and guided to its support position. The groove 10*a* extends from its top part toward the lower part and in the direction substantially perpendicular to the plane of the top surface of the carriage 2**.

The supporting plate 10 has at its bottom rear part a projection **10*b* formed in a manner to be bent outwardly (i.e., in the direction normal to the surface of the drawing sheet), and at its lower front side another projection 10*c* formed in the same manner as the projection 10*b*. Further, at the substantially lower center part of the supporting plate 10, there is fixedly provided a pin 11, with which the above-mentioned engaging and holding member 12 for engageably holding the projection 8*b***, is pivotally held in a freely rotatable manner.

The engaging and holding member 12 is a plate having a generally oval shape, the upper front side of which forms a cam surface **12*a* in curvature. In its center part toward the front, the oval shaped member 12 has a notch 12*b*** in a complicated outline.

The upper side of the notched portion **12*b* has a projection 12*c* formed at its entrance which is continuous with the cam face 12*a*, an arcuate groove 12*d* at its inner part, and a rectangular projection 12*e* at its innermost part. The distal end of the rectangular projection 12*e* is bent outwardly (i.e., in the direction toward the surface of the drawing sheet). As will be described later in detail, this projection 12*e* functions to engage and release the projection 8*b* with and from the engaging and holding member 12, and it constitutes an engaging and releasing part. The engaging and holding member 12, at the final stage of its operation, becomes engaged with the projection 8*b* in the arcuate groove 12*d*, thereby holding the projection 8*b* at its mounting position. Accordingly, this arcuate groove 12*d* functions as the engaging and holding part for the projection 8*b***.

The lower side of notched portion **12*b* has at its left-hand side a flat surface part 12*k* which collides with the projection 8*b* when it comes downward in the direction of the arrow A to restrain further movement of this projection 8*b* in this direction. Therefore, the part 12*k* has a function of a stopper. At the substantially center part of this lower side, there is formed a triangular projection 12*f*, behind which an arcuate groove 12*g*** is formed.

At the bottom of the engaging and holding member 12, there is formed a projection **12*h*. Further, at the lower back side of this engaging and holding member 12, behind the projections 12*h*, there is formed a downwardly directing rectangular projection 12*i*** with its distal end being bent outwardly (i.e., in the direction toward the surface of the drawing sheet.)

Figure 7A:
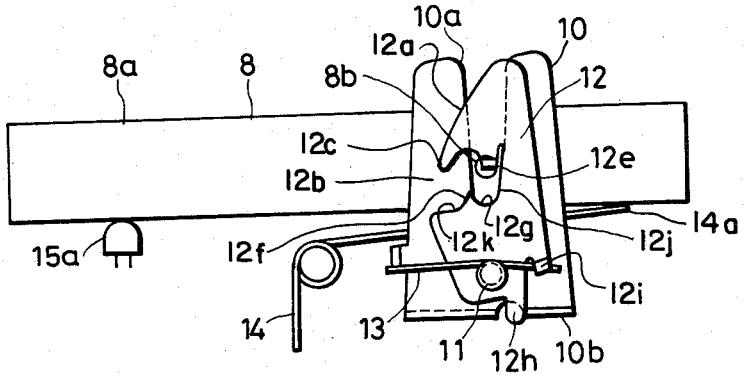
Figure 7B:
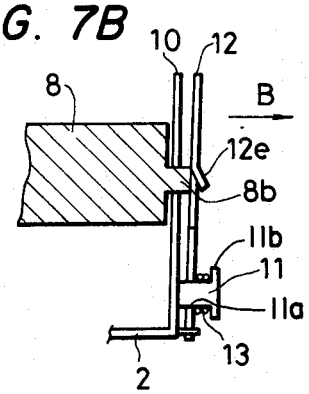
FIG. 7B is a partial front view, in longitudinal cross-section, showing a manner, in which the ink ribbon cassette is released from the cassette mounting mechanism, as shown in FIG. 7A above.

The engaging and holding member 12 of the above-mentioned structure has a perforation **11*a* formed at the substantially lower center part thereof, through which the member 12 is pivotally supported on the pin 11 in a freely oscillatable manner. In this case, the pin 11 projects outwardly from the surface of the engaging and holding member 12, and is formed at its distal end with a flanged portion 11***b* (FIG. 7B). A torsion coil spring 13 as an urging member is resiliently provided between this flanged portion and the engaging and holding member 12.

The torsion coil spring 13 as a compression coil spring urges the engaging and holding member 12 toward the supporting plate 10. Its one end is engaged with the projection 10*c* at the front side of the supporting plate 10, while the other end is engaged with the projection 12*i* at the rear side of the engaging and holding member 12 to thereby constantly urge the engaging and holding member 12 in the counter-clockwise direction.

As is understandable from the preceding description, this torsion coil spring 13 as the urging member permits the engaging and holding member 12 to rotate in the clockwise direction when the projection 8*b* is pushed into it from the direction of the arrow A for mounting the ink ribbon cassette 8 on the carriage 2, causes the engaging and holding member 12 to rotate again in the counter-clockwise direction when the projection 8*b* runs over the projection 12*c*, and finally engages and holds this projection 8*b* in the arcuate groove 12*d* in the upper side of the notch 12*b*. In this case, a double torsion spring 14 to be mentioned later urges the cassette 8 upward. Further, the torsion coil spring 13 carries out its function of pushing the cassette 8 further down from its mounted position in the direction A, disengaging the projection 8*b* from the groove 12*d* when the pressing force is released, and enabling the cassette 8 to be removed from the engaging and holding member 12. (This disengaging action will be described in detail hereinafter.)

As mentioned in the foregoing, the double torsion spring 14, one end of which is fixed at substantially the center part of the carriage 2, urges the bottom surface 8*c* of the cassette 8 by its free end 14*a* in such a manner that the bottom surface 8*c* may be pushed upward to thereby urge the cassette 8 in the counter-clockwise direction as shown in the drawing. Therefore, this double torsion spring 14 has also a function of pushing the cassette 8 in its removing direction, or in the upward direction, when the projection 8*b* of the cassette 8 is disengaged from the engaging and holding member 12.

From the above-described construction, it may be said that the engaging and holding member 12, torsion coil spring 13, and double torsion spring 14, when combined together, constitute the engaging and holding means for the projection 8*b* of the cassette 8. And, this engaging and holding means holds the cassette 8 in a freely oscillatable manner with the projection 8*b* as the center of its oscillation. More strictly and accurately, the above-mentioned combination with further addition of the supporting plates 10 constitutes the engaging and holding means.

Furthermore, a ribbon solenoid 15 is energized at the time of the printing operation to raise the solenoid armature 15*b* with the consequent push-up of the forward end of the cassette 8 by a cap 15*a* at the distal end of the armature 15*b*, as shown by a dot-and-dash line in the drawing. As the result of this, the ink ribbon 9 extended and exposed outside at the forward end of the cassette 8 is shifted to a position facing any of the characters in the character wheel 4. The solenoid 15, in its non-energized condition, holds the cassette 8 at a position for verifying the characters in a lower printed line, and, in its energized condition, holds the same at a position for verifying the characters in an upper printed line. Further, this ribbon solenoid 15 is in contact with the cassette 8 only through the cap 15*a*. Therefore, when viewing the cassette 8 from its top surface, the cassette 8 is supported at three points namely at the pair of projections 8*b*, 8*b* and a position where the cassette 8 is in contact with the cap 15*a*. More specifically, the ribbon solenoid 15 is positioned below either end of the arm portions 8*a*, 8*a* of the cassette 8 placed on the carriage 2.

In the above-described construction, the projection 8*b* of the cassette 8 is fitted in the groove 10*a* of the supporting plate 10, and urged upwardly by the double torsion spring 14 to be engaged with the groove 12*d* of the engaging and holding member 12 which is urged in the counter-clockwise direction in the drawing. On the other hand, one of the arm portions 8*a* at the forward end part of the cassette 8 is supported at its lower surface by the ribbon solenoid 15, whereby the cassette 8 rests on the carriage 2.

Mounting of the Cassette

In the following, explanations will be given, with reference to FIGS. 3 to 5, as to the operations for mounting the cassette 8 by the cassette mounting mechanism of the above-described construction.

Figure 3:
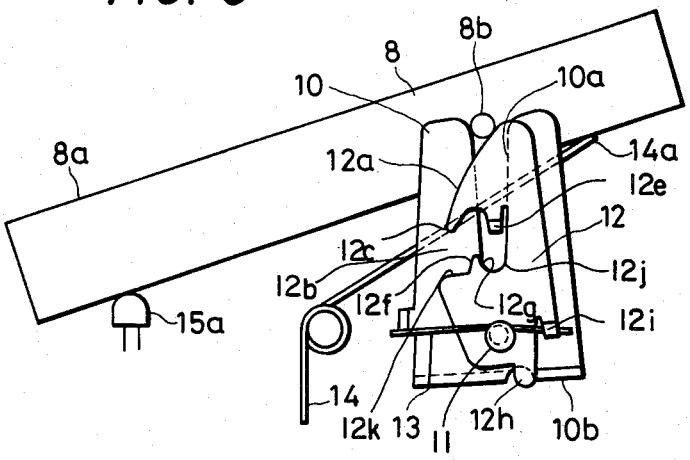

As shown in FIG. 3, the engaging and holding member 12 before mounting of the cassette 8 thereon is urged in the counter-clockwise direction, the projection 12*h* at the bottom part of the member 12 is in contact with the projection 10*b* of the supporting plate 10 to be restrained in its further movement thereby, and the engaging and supporting member 12 stands substantially upright. A V-shaped cleft is formed by and between the cam face 12*a* at the upper front side of the engaging and holding member 12 and the groove 10*a* of the supporting plate 10.

In the above-mentioned state, an operator of the printing device first puts the arm portion 8*a* at the forward end part of the cassette 8 on the cap 15*a* of the ribbon solenoid 15, and brings the projection 8*b* into contact with the V-shaped cleft between the cam face 12*a* and the groove 10*a*. At this time, the bottom part of the cassette 8 is in contact with the free end 14*a* of the double torsion spring 14.

Next, when the cassette 8 is pushed downward by the fingers of the operator against the urging force of the double torsion spring 14, the projection 8*b* pushes the engaging and holding member 12 backward along the inclination of the cam face 12*a*, and comes down into the groove 10*a* of the supporting plate 10 along the direction A, while pushing away the engaging and holding member 12 by causing it to pivot in the clockwise direction against the urging force of the torsion coil spring 13.

Figure 4:
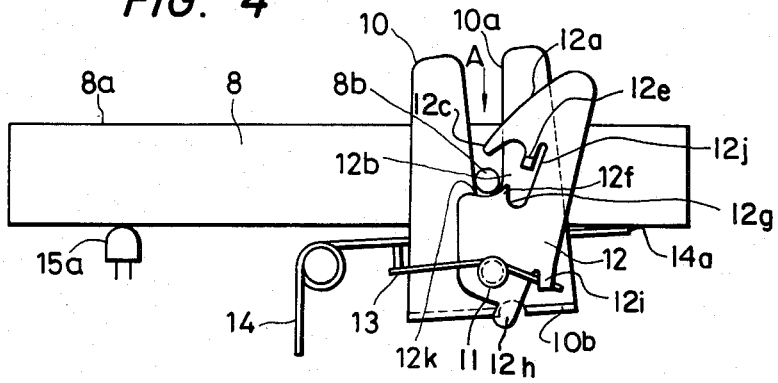

As soon as the projection 8*b* comes down to a certain position as shown in FIG. 4, it comes into contact with the flat portion 12*k* at the lower side of the notched portion 12*b* in the engaging and holding member 12, whereby it is no longer able to come down further.

When the operator removes his or her fingers from the cassette 8 which has so far been depressed by them, the rear part of the cassette 8 is pushed upward with the energizing force of the double torsion spring 14, and the projection 8*b* goes upward in and along the groove 10*a*. In the meantime, the engaging and holding member 12 pivots in the counter-clockwise direction as shown in the drawing with the urging force of the torsion coil spring 13, and the projection 12*c* at the upper side of the notched portion 12*b* catches the projection 8*b* to engage the same with the groove 12*d* as shown in FIG. 5.

The above-mentioned state is the same as that of FIG. 2 which has been explained previously. That is to say, the cassette 8 causes its projections 8*b* to be engaged with the groove 12*d* of the engaging and holding member 12 and retained in the groove 10*a* of the supporting plate 10, while the forward end part 8*d* of the cassette 8 is supported from its bottom surface 8*c* with the cap 15*a* of the ribbon solenoid 15, whereby it can be mounted on the carriage 2.

As mentioned above, the operator puts the forward end part 8*d* of the cassette 8 on the cap 15*a* of the ribbon solenoid 15 and then places the projection 8*b* thereof on the top part of the groove 10*a* of the supporting plate 10, followed by once depressing the cassette 8 to the position where it collides with the flat surface portion 12*k* of the notched part 12*b* in the engaging and holding member 12, whereby the cassette 8 can be mounted on the carriage 2.

Removal of the Cassette

In the following, explanations will be given, with reference to FIGS. 5 to 7A and 7B, as to removal of the cassette 8 from the cassette mounting mechanism.

Figure 5:
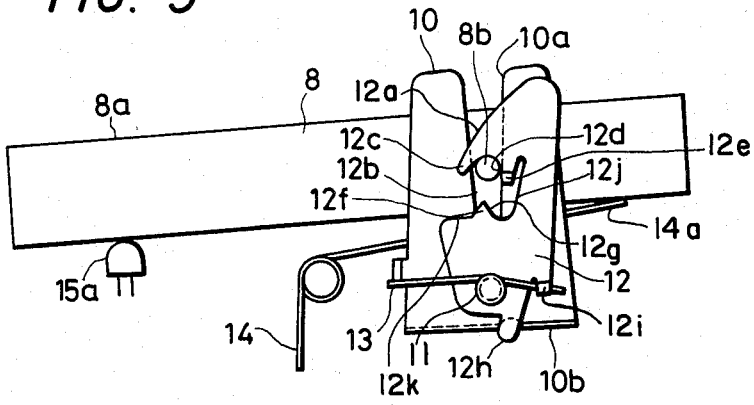
Figure 6:
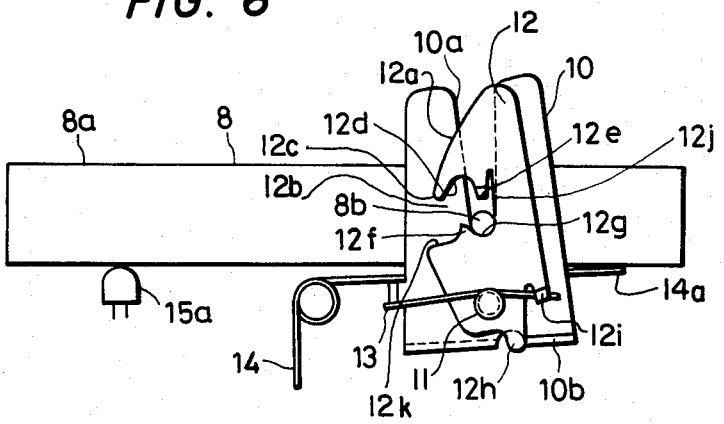

From the state of FIG. 5 as has already been described in the foregoing, the operator depresses the rear of the cassette 8 with his or her fingers against the energizing force of the double torsion spring 14, whereupon the projection 8*b* goes down in and along the groove 10*a* in the direction A.

When the upper surface of the descending projection 8*b* becomes lower than the bottom surface of the projection 12*e* on the upper side of the notched portion 12*b* of the engaging and holding member 12, and disengaged from the groove 12*d*, the engaging and holding member 12 is rotated in the counter-clockwise direction in the drawing by the urging force of the torsion coil spring 13 to guide the projection 8*b* in and along a U-shaped groove formed by the curved surface of the projection 12*e* at its right-hand side and the opposite surface 12*j* of the notched portion 12*b*. When the projection 8*b* is lowered further, it becomes engaged with and stopped by the arcuate groove 12*g* at the lower side of the notched portion 12*b*, whereby the projection 8*b* can no longer go down further.

In the above-described state, when the operator removes his or her fingers from the cassette 8 which has so far been depressed by them, the rear part of the cassette 8 is pushed upward with the energizing force of the double torsion spring 14, and the projection 8*b* jumps up in the groove 10*a*.

At this instant, the projection 12*e* comes just above the projection 8*b*. However, since the distal end of the projection 12*e* is bent outwardly (i.e., in the direction toward the surface of the drawing sheet), the distal end of the projection 8*b* slides into the inner surface of the projection 12*e* as clearly illustrated in FIG. 7B.

Further, the projection 8*b* which goes upwardly with the urging force of the double torsion spring 14 causes the engaging and holding member 12 to displace outwardly, i.e., in the direction of an arrow B in FIG. 7B, through the inner slant surface of the projection 12*e* and against the urging force of the torsion coil spring 13, and with the pin 11 as the center of displacement. Then the projection 8*b* slides inside the upper part of the engaging and holding member 12. Further, the projection goes upwardly to be disengaged from the engaging and holding member 12 and becomes removable from the carriage 2 when the cassette 8 is lifted up.

As mentioned above, the projection 8*b* of the cassette 8 is released from the engaging and holding member 12 when the operator pushes the rear part of the cassette 8 mounted on the carriage 2 down to a position where it collides with the lower surface 12*g* of the notched portion 12*b*, followed by removing his or her fingers from it. After this, when the cassette 8 is lifted, it can be removed from the carriage 2.

As is apparent from the foregoing explanations, the preferred embodiment of the present invention is such that, for mounting or removing the cassette 8 on or from the carriage 2, the operator can only push the cassette 8 once, hence the operation is very simple, owing to which there is no possibility of the cassette 8 mounting mechanism or the cassette 8 itself being damaged by any erroneous operation on the part of the operator. In addition, the construction of the mechanism as a whole can be made extremely simple.

Although, in the foregoing, the present invention has been described with reference to a preferred embodiment thereof, it should be noted that the embodiment is merely illustrative and not restrictive, and that any changes and modifications may be made by those persons skilled in the art without departing from the spirit and scope of the invention as recited in the appended claims. For instance, in the above-described embodiment, the projection 8*b* as the pivot point for oscillation of the cassette 8 is supported, by the engaging and holding member 12, but this projection 8*b* may be replaced by a cavity (not shown) if it serves as the pivot point for oscillation of the cassette 8. Further, any other projection or cavity (not shown) than that serving as the pivot point for oscillation may be engaged with and held by the engaging and holding member 12.

What I claim is:

1. A mechanism for mounting an ink ribbon cassette containing therein an ink ribbon and having an engaging part on a wall surface thereof, said mechanism comprising:

(a) guide means for guiding an ink ribbon cassette in a predetermined direction to a predetermined position; and (b) engaging and holding means for engaging with said engaging part of said ink ribbon cassette to hold said engaging part at said predetermined position when said ink ribbon cassette is shifted in said predetermined direction to said predetermined position; said engaging and holding means releasing the engagement with said engaging part when said ink ribbon cassette is further shifted in said predetermined direction, and including means for urging said ink ribbon cassette in the direction opposite to said predetermined direction when said engaging part is so released.

2. The mechanism as set forth in claim 1, wherein said guide means is formed to guide said engaging part of said ink ribbon cassette into contact therewith.

3. The mechanism as set forth in claim 1, wherein said engaging and holding means includes an engaging and holding member having a holding part to be engaged with and hold said engaging part of said ink ribbon cassette, and an urging member for imparting an urging force to said engaging and holding member so as to release the engagement between said engaging part and said holding part by further shifting of said ink ribbon cassette in said predetermined direction.

4. The mechanism as set forth in claim 3, wherein said engaging and holding member includes a stopper portion which becomes engaged with said engaging part at the time of shifting of said ink ribbon cassette in said predetermined direction to restrain further shifting of said ink ribbon cassette.

* * * * *